United States Patent [19]

Borowski et al.

[11] Patent Number: 4,874,004

[45] Date of Patent: Oct. 17, 1989

[54] COAXIAL CIGARETTE

[75] Inventors: Horst Borowski, Hamburg; Erwin Kausch, Jesteburg; Erhard Rittershaus; Gert Rudolph, both of Hamburg; Werner Schneider, Quickborn, all of Fed. Rep. of Germany

[73] Assignee: B.A.T. Cigarettenfabriken GmbH, Hamburg, Fed. Rep. of Germany

[21] Appl. No.: 281,640

[22] Filed: Dec. 9, 1988

[30] Foreign Application Priority Data

Dec. 22, 1987 [DE] Fed. Rep. of Germany ..... 3743597

[51] Int. Cl.[4] ..... A24D 1/00; A24C 5/18

[52] U.S. Cl. ..... 131/364; 131/361

[58] Field of Search ..... 131/364, 360, 361, 336

[56] References Cited

U.S. PATENT DOCUMENTS 3,614,956 10/1971 Thornton ..... 131/364

4,459,998 7/1984 Labbe ..... 131/364

4,716,913 1/1988 Brackmann ..... 131/364

4,727,888 3/1988 Luke ..... 131/364

*Primary Examiner*—V. Millin

*Attorney, Agent, or Firm*—Kerkam, Stowell, Kondracki & Clarke

[57] ABSTRACT

A coaxial cigarette comprising an inner core of a material, which glows substantially residue-free, in particular tobacco material, a wrapper for the inner core, an outer jacket which consists of a tobacco and/or non-tobacco material and coaxially surrounds the inner core and its wrapper, and a wrapper for the outer jacket, has a ventilated coaxial filter with a filter core, the internal diameter of which corresponds substantially to the diameter of the inner core, and with a filter jacket; the filter core has an air-impermeable wrapper; the filter jacket has an air-permeable wrapper; the wrapper of the inner core and the wrapper of the outer jacket are provided with glow agents; and the draw resistance of the inner core is lower than the draw resistance of the outer jacket.

20 Claims, 1 Drawing Sheet

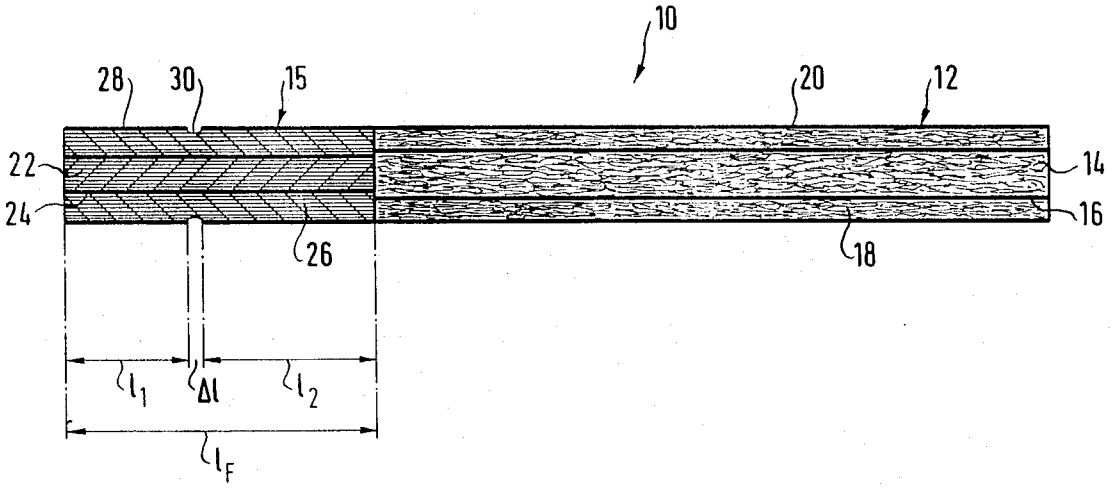
10
12
14
16
18
20
15
26
28
30
22
24
$l_1$
$\Delta l$
$l_2$
$l_F$

COAXIAL CIGARETTE

BACKGROUND OF THE INVENTION

1. Field of the Invention

The invention relates to a coaxial cigarette comprising an inner core of a material which glows substantially residue-free, in particular tobacco material, a wrapper for the inner core, an outer jacket of a tobacco and/or non-tobacco material surrounding the inner core or its wrapper respectively, and a wrapper for the outer jacket.

2. Description of the Prior Art

There are a number of publications on so-called "coaxial smokable articles", i.e. in particular coaxial cigars or cigarettes having an inner core which is surrounded by a jacket of tobacco material. The basic principle of such a coaxial cigarette is known, for example, from French patent specification No. 998,556, in this case the inner core consists of a tobacco of lower quality which is surrounded by an annular jacket of tobacco of high quality. This permits savings as regards the costs of the tobacco materials used.

Further forms of such coaxial cigarettes are known from French patent specification No. 1,322,254, U.S. Pat. No. 3,614,956, U.S. Pat. No. 4,219,031, British patent application No. 2,070,409 and British patent specification No. 1,086,443.

A coaxial cigarette of the type as defined above is known from German Offenlegungsschrift No. 3,602,846 and comprises an inner core of a residue-free glowing material, a wrapper for the inner core, an outer jacket consisting of a tobacco and/or non-tobacco material and coaxially surrounding the inner core and a wrapper for the outer jacket. The particular advantage of this coaxial cigarette is that it can be made with the usual production techniques on specially modified cigarette-making machines.

A disadvantage is, however, that in this coaxial cigarette no filter is provided for trapping undesired smoke constituents.

Finally, U.S. Pat. No. 3,356,094 discloses a coaxial cigarette having an inner hollow tube and an aerosol chamber with narrow outlet; the production of this coaxial cigarette is, however, very complicated and thus expensive; moreover, the various components of said cigarette are separate from each other and this results in an unusual smoke pattern.

SUMMARY OF THE INVENTION

The invention therefore has as its object the provision of a coaxial cigarette of the type referred to above in which the aforementioned disadvantages do not occur.

In particular, a coaxial cigarette is provided in which the undesired smoke constituents can be almost completely trapped.

The invention therefore affords a coaxial cigarette comprising an inner core of a substantially residue-free glowing material, in particular tobacco material, a wrapper for the inner core, an outer jacket of a tobacco and/or non-tobacco material surrounding the inner core or its wrapper, and a wrapper for the outer jacket, the improvement comprising a ventilated coaxial filter comprising a filter core, the internal diameter of which corresponds substantially to the diameter of the inner core and a filter jacket; the filter core has an air-impermeable wrapper; the filter jacket has an air-permeable wrapper; the wrapper of the inner core and the wrapper of the outer jacket are provided with glowing agents or additives; and the draw resistance of the inner core is lower than the draw resistance of the outer jacket.

Preferred embodiments are illustrated below and the scope of the invention is defined by the claims.

The advantages achieved with the invention are due to the fact that during each draw the created combustion products of the rod portion are led axially through the coaxial cigarette in the annular outer jacket and thereby separately from the inner core and absorbed by a special coaxial filter; this coaxial filter treats the peripheral smoke flowing through its filter jacket and the central smoke flowing through its filter core in a very different manner adapted to said two types of smoke to give an optimum filter effect.

Specifically the gas phase of the smoke is reduced by diffusion and ventilation whilst the particle phase is reduced by ventilation and simultaneously absorbed by a high-efficiency filter segment.

Both the tobacco rod and the coaxial filter of this coaxial cigarette can be made with existing technologies fundamentally known in the prior art so that only corresponding modifications to the present machines are necessary.

The resulting smoke inhaled by the smoker is of acceptable flavour and contains only little condensate which, in addition, is substantially free from the otherwise usual combustion products; the smoking process itself is not changed so that the "smoking experience" can be retained for the smoker.

In the invention the fact is utilized that during the draw phase the combustion products emanate substantially only from the periphery, i.e. the jacket region of the coaxial cigarette, so that in this region specific appropriate steps can be taken to trap the undesired smoke products. Moreover, an optimized tobacco rod can now be properly combined with an optimized two-stream filter to obtain the desired flavour in conjunction with an extensive reduction of the undesired smoke constituents.

BRIEF DESCRIPTION OF THE DRAWINGS

The invention will be described in more detail hereinafter with reference to examples of embodiment with the aid of the attached schematic drawing, the single FIGURE of which shows an axial section through a coaxial cigarette.

DESCRIPTION OF THE PREFERRED EMBODIMENTS

The coaxial cigarette shown in the figure, denoted generally by the reference numeral 10, comprises a rod portion 12 to which a coaxial filter 15 is attached with the usual production techniques. The rod portion 12 contains an inner core 14 having a wrapper 16 and an outer jacket 18 having a wrapper 20.

In similar manner the coaxial filter 15 consists of a filter core 22 having a wrapper 24 and a filter jacket 26 having a wrapper 28. The coaxial filter 15 is ventilated, as will be explained below; the ventilation means is indicated as a line of punctiform ventilation openings 30 which extend over the periphery of the coaxial filter 15.

The inner core 14 of the rod portion 12 has a diameter of 3 to 5 mm whilst the diameter of the outer jacket 18 of the rod portion 12 is at the most 8 mm so that said rod portion 12 corresponds substantially to the usual diameter of "ordinary" cigarettes.

The inner core 14 consists of a porous carrier substance of high absorbability for the combination of aroma and/or flavouring substances which is also referred to as "casing", said substances usually being present in solvents and containing sugar, moistening agents and similar substances; this is also known as "saucing"; this "casing" is added to the tobacco material prior to the cutting.

Based on the carrier substance the absorbability for "casing" should be greater than 3% by weight.

A preferred carrier substance is tobacco material, i.e. cut tobacco, tobacco sheet or extruded tobacco; thermally decomposable non-tobacco materials can, however, also be employed. The important point is that the carrier substance of the inner core 14 burns away to leave practically no residue.

The resulting residues should be very small; it is therefore possible to add glass fibres or other mineral fibres to the carrier substance of the inner core 14 to obtain a certain filtering action already in the core 14.

If the inner core 14 contains tobacco material the latter must have a high aroma content and/or a high condensate potential and a low carbon monoxide potential.

The wrapper 16 of the inner core 14 of the rod portion 12 has a comparatively low porosity. As wrapper 16 in particular cigarette paper can be used, conveniently a cigarette paper which consists at least partially of tobacco raw material.

Alternatively, the wrapper 16 of the inner core 14 may also be made from tobacco foils or sheets or other sheets of natural material.

The outer jacket 18 of the rod portion 12 consists of tobacco materials and/or non-tobacco materials of low condensate potential and with high filling ability with a package density of at the most 220 mg/ml.

As outer wrapper 20 of the outer jacket 18 porous cigarette paper is used which has an air permeability which is greater than 30 CU (Coresta Units=$cm^3/min \times cm^2 \times 100$ mm WS).

The important point is that the generally different glow agents, more particularly glow or burning salts, and glow agent concentrations are applied as additives to the inner wrapper 16 of the inner core 14 and the outer wrapper 20 of the outer jacket 18 of the rod portion 12 either uniformly over their entire area or as glow agent patterns; in each case a specific glow agent or a mixture of several different glow agents may be used.

The amount of glow agents for the inner wrapper 16 and the outer wrapper 20 must be matched so that altogether for the inner core 14 and the outer jacket 18 a glowing rate is achieved which ensures an adequate uniform mass conversion for the inner core 14 and the outer jacket 18 of the rod portion 12. In particular, it must be excluded that cavities or similar defects occur due to locally high glowing rates.

The draw resistance of the inner core 14 of the rod portion 12 must be lower than the draw resistance of the outer jacket 18 of the tobacco rod 12.

The outer diameter of the coaxial filter 15 corresponds to the outer diameter of the rod portion 12, i.e. is at the most 8 mm.

The diameter of the filter core 22 corresponds substantially to the diameter of the inner core 14 of the rod portion 12 but according to a preferred embodiment should be about 0.1 to 1 mm smaller than the latter, as indicated in the Figure, in order to exclude any possibility of smoke passing from the outer jacket 18 into the filter core 22.

The coaxial filter 15 is ventilated and has a ventilation rate of 50 to 80%.

For this purpose, as outer wrapper 28 a highly porous wrapper and highly porous tipping paper is used with an additional laser-perforated ventilation zone 30 at least through the tipping paper. If the ventilation zone is formed as illustrated by a line of punctiform ventilation openings 30 extending in the peripheral direction, then the line of said openings 30 should be spaced at a distance of at least 10 mm from the mouth-side end of the coaxial filter 15.

The length of the coaxial filter 15 should lie in the range from 21 to 30 mm. Accordingly, the ventilation zone 30 should be at least 9 mm away from the end face of the coaxial filter 15 facing the rod portion 12, the aim being to maintain as small a spacing as possible from the mouth-side end face.

If the distance between the mouth-side end face of the coaxial filter 15 and the ventilation zone 30 is denoted by $l_1$, the width of the ventilation zone 30 by $\Delta 1$, the length of the coaxial filter 15 by $l_F$ and the distance between the ventilation zone 30 and if the end face of the coaxial filter 15 facing the rod portion 12 is denoted by $l_2$, then the following equation holds:

$$l_F - l_2 = l_1 + \Delta l.$$

As already mentioned, the wrapper 28 of the filter jacket 26 is porous and consists of a wrapper paper and a tipping paper. The tipping paper should have a porosity of more than 5000 CU and the wrapper paper a porosity of more than 10000 CU.

Possible materials for the two filter zones, i.e. for the filter core 22 and the filter jacket 26, are the usual filter materials as employed at present in the cigarette industry.

Alternatively, the filter core 22 can consist of porous carrier materials with high specific surface area, in particular foamed, extruded, sintered, pressed or molded materials such as coal, tobacco or non-tobacco materials. In this variant the filter jacket 26 again consists of the usual filter materials.

In both variants the carrier materials for the filter core 22 should contain additives, that is firstly the usual additives such as, for example, triacetine, flavouring and aroma substances and/or substances substantially neutral in flavour with high transfer coefficient to the core smoke.

The filter core 22 is surrounded by an air-impermeable wrapper 24 which may consist, for example, of non-porous filter paper.

For the two filter zones 22, 26 the following specifications may be defined:

The ratio of the specific draw resistances of the filter jacket 26 to that of the filter core 22 "measured closed", i.e. measured without taking account of the ventilation, is at least 1.4.

With respect to the peripheral smoke stream, the peripheral filter jacket 26 has together with the ventilation through the ventilation openings 30 a reduction rate of at least 90%; and the filter core 22 has, with respect to the core smoke, a filter efficiency of at the most 40%.

Thus, in the coaxial cigarette 10 described combustion products are created both in the inner core 14 and in the outer jacket 18 of the rod portion 12. During a draw the combustion products originate substantially only from the outer jacket 18 of the rod portion 12 so that almost all the combustion products can be conducted along separate paths, led through the coaxial filter 15 and influenced thereby specifically so that without impairing the flavour the amount of condensate is small and the condensate is substantially free from the otherwise usual combustion products.

We claim:

1. A coaxial cigarette comprising an inner core of a smokable material which burns substantially residue-free, a first wrapper for the inner core, an outer jacket of another smokable material surrounding the inner core, a second wrapper for the outer jacket, and a ventilated coaxial filter comprising a filter core having an internal diameter which corresponds substantially to a diameter of the inner core, and a filter jacket; the filter core having an air-impermeable third wrapper; the filter jacket having an air-permeable fourth wrapper; the first wrapper of the inner core and the second wrapper of the outer jacket being provided with glowing agents; and a draw resistance of the inner core being lower than another draw resistance of the outer jacket.

2. A coaxial cigarette according to claim 1, wherein the coaxial filter has a ventilation of 50 to 80%.

3. A coaxial cigarette according to claim 1, wherein the internal diameter of the filter core is somewhat smaller than the internal diameter of the inner core.

4. A coaxial cigarette according to claim 1, wherein the third wrapper of the filter core comprises of an air-impermeable cigarette paper.

5. A coaxial cigarette according to claim 1, wherein the fourth wrapper of the filter jacket comprises a highly porous wrapper paper and a highly porous tipping paper with a laser-perforated ventilation zone at least through the tipping paper.

6. A coaxial cigarette according to claim 5, wherein the tipping paper has a porosity of at least 5000 CU and the wrapper paper has another porosity of at least 10000 CU.

7. A coaxial cigarette according to claim 1, wherein the filter core comprises porous carrier materials with a large specific surface area.

8. A coaxial cigarette according to claim 7, wherein said carrier materials are selected from the group consisting of foamed, extruded, sintered, pressed and molded materials, including coal, tobacco and non-tobacco materials.

9. A coaxial cigarette according to claim 1, wherein at least one of the filter materials of the filter core and the filter jacket are provided with additives.

10. A coaxial cigarette according to claim 1, wherein the draw resistance of the filter jacket has a ratio to the draw resistance of the filter core measured closed of at least 1.4.

11. A coaxial cigarette according to claim 1, wherein the filter jacket has a reduction rate with respect to a peripheral smoke stream of at least 90% with ventilation.

12. A coaxial cigarette according to claim 1, wherein the filter core has a filter efficiency with respect to the core smoke of at the most 40%.

13. A coaxial cigarette according to claim 1, wherein the inner core comprises a porous carrier substance with high absorbability for casing.

14. A coaxial cigarette according to claim 13, wherein the carrier substances comprise at least one of tobacco material and thermally decomposable non-tobacco material.

15. A coaxial cigarette according to claim 14, wherein said tobacco material comprises a material of at least one of high aroma content and high condensate potential, and low carbon monoxide potential.

16. A coaxial cigarette according to claim 1, wherein the wrapper of the inner core is slightly porous.

17. A coaxial cigarette according to claim 16, wherein the wrapper of the inner core comprises one of cigarette paper, tobacco foils and other foils of natural materials.

18. A coaxial cigarette according to claim 17, wherein the cigarette paper contains at least partially raw material.

19. A coaxial cigarette according to claim 1, wherein the outer jacket contains at least one of tobacco materials and non-tobacco materials of low condensate potential and high filling capacity.

20. A coaxial cigarette according to claim 1, wherein the wrapper of the outer jacket comprises porous cigarette paper having an air permeability of more than 30 CU.

* * * * *